US009963890B1

(12) United States Patent
Allen

(10) Patent No.: US 9,963,890 B1
(45) Date of Patent: May 8, 2018

(54) GRIDLOCKED UNFURLABLE PLATFORM AND RELATED METHODS

(71) Applicant: Adrian Allen, El Cajon, CA (US)

(72) Inventor: Adrian Allen, El Cajon, CA (US)

( * ) Notice: Subject to any disclaimer, the term of this patent is extended or adjusted under 35 U.S.C. 154(b) by 0 days. days.

(21) Appl. No.: 15/658,263

(22) Filed: Jul. 24, 2017

Related U.S. Application Data

(63) Continuation-in-part of application No. 29/609,053, filed on Jun. 28, 2017.

(51) Int. Cl.
*E04G 5/00* (2006.01)
*E04G 3/00* (2006.01)
*E04G 5/08* (2006.01)
*E04F 15/16* (2006.01)

(52) U.S. Cl.
CPC ..... *E04G 5/001* (2013.01); *E04F 15/166* (2013.01); *E04G 3/00* (2013.01); *E04G 5/08* (2013.01)

(58) Field of Classification Search
CPC ... E04G 5/001; E04G 3/00; E04G 5/08; E04F 15/166
See application file for complete search history.

(56) References Cited

U.S. PATENT DOCUMENTS 48,907 A 7/1865 Colby
488,371 A 12/1892 Smith
945,575 A 1/1910 McPherson
2,551,976 A 5/1951 Smith
3,611,655 A * 10/1971 Loebner ..... E04F 15/105 160/133
3,730,140 A 5/1973 Bowser et al.
3,894,370 A 7/1975 Parzader
3,913,291 A 10/1975 Dulien et al.
4,568,587 A 2/1986 Balzer
4,681,482 A 7/1987 Arciszewski et al.
4,771,586 A 9/1988 Schmidt
5,275,502 A * 1/1994 Glaza ..... E01C 19/522 404/35
5,282,692 A * 2/1994 McLeod ..... E01C 9/086 404/35
5,947,178 A * 9/1999 Patten ..... E04H 4/088 160/193
5,966,777 A 10/1999 Hinge
6,968,652 B1 11/2005 Eadie
7,090,430 B1 * 8/2006 Fletcher ..... E01C 9/086 404/35
7,364,383 B2 * 4/2008 Fletcher ..... E01C 9/086 404/35
8,161,690 B1 4/2012 Borne et al.
8,534,003 B2 * 9/2013 Curry, III ..... E04B 1/3205 52/592.1
8,595,987 B2 * 12/2013 Curry, III ..... E04C 2/284 52/592.1

(Continued)

*Primary Examiner* — Rodney Mintz
(74) *Attorney, Agent, or Firm* — Buche & Associates, P.C.; Bryce A. Johnson; John K. Buche

(57) ABSTRACT

Disclosed is a rollable platform that may be unfurled in any orientation over exposed floor or ceiling joists. The platform may be constructed of a specific arrangement of support surface panels and underside joint panels to give the platform both (a) rigidity in a direction that is normal to the support surface via gridlock between the support surface panels and (b) foldability and/or rollability in a direction that is normal to the underside joint panels due to hinged interconnection.

1 Claim, 14 Drawing Sheets

(56) References Cited

U.S. PATENT DOCUMENTS

| | | | | |
|---|---|---|---|---|
| 8,733,059 | B1 | 5/2014 | Hamra | |
| 8,784,002 | B2 * | 7/2014 | Ringus | E01C 9/02 14/2.5 |
| D731,080 | S | 6/2015 | Poplawski et al. | |
| 9,556,611 | B1 | 1/2017 | Huckey et al. | |
| 9,587,407 | B2 * | 3/2017 | Newman | E04F 13/0862 |
| 9,725,899 | B2 * | 8/2017 | Huckey | E04B 5/02 |
| 2007/0272373 | A1 * | 11/2007 | Curry, III | E04C 2/284 160/230 |
| 2009/0321023 | A1 * | 12/2009 | Curry, III | E04B 1/3205 160/133 |
| 2015/0308124 | A1 * | 10/2015 | Newman | E04F 13/0862 52/747.11 |
| 2016/0129299 | A1 | 5/2016 | Newman | |
| 2017/0121970 | A1 * | 5/2017 | Huckey | E04B 5/02 |

* cited by examiner

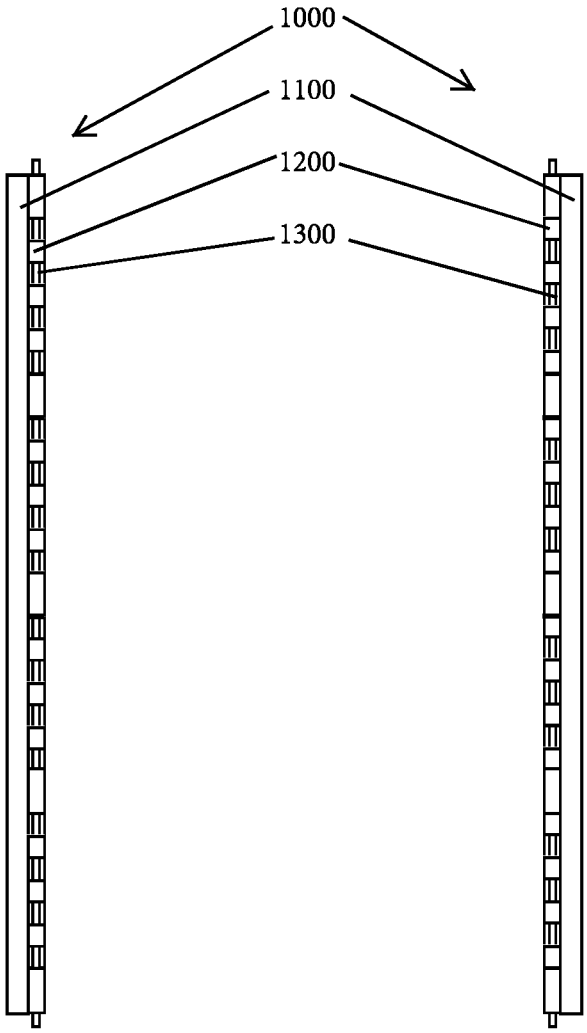
FIG. 5
FIG. 6
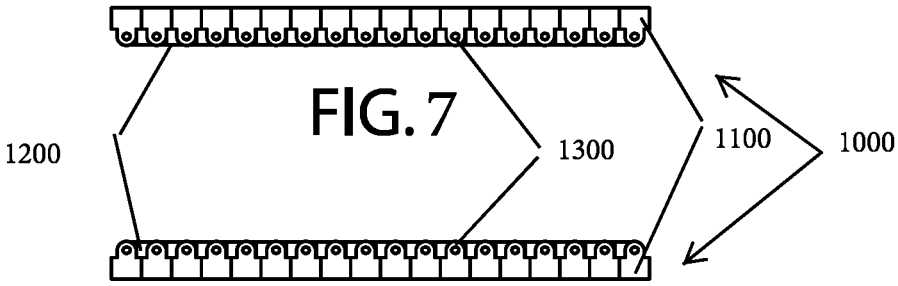
FIG. 7
FIG. 8

GRIDLOCKED UNFURLABLE PLATFORM AND RELATED METHODS

CROSS-REFERENCE TO RELATED APPLICATIONS

This application is a continuation-in-part of U.S. patent application Ser. No. 29/609,053 (filed Jun. 28, 2017) by Adrian Allen for a "Gridlocked unfurlable platform."

STATEMENT REGARDING FEDERALLY SPONSORED RESEARCH OR DEVELOPMENT

Not applicable.

THE NAMES OF THE PARTIES TOA JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of portable platforms that support objects over the space between two support structures, like beams or joists.

Background of the Invention

During construction and maintenance of homes, buildings, or other structures, a worker or other technician may be required to work over and across the spaces between exposed joists or beams. Such exposed beams or joists pose navigational challenges and safety threats to the worker. So, a need exists for platforms or other supports that may be positioned over the space between two beams/joists so that safety threats and navigational challenges can be reduced or eliminated.

Unitary platforms, like the JoistMate® (represented by U.S. Des. Pat. No. D731,080 (issued Jun. 2, 2015) for "Movable platform") are simple constructs that somewhat meet the above identified need. In use, the unit is positioned to span two adjacent beams and is capable of supporting a worker or tool over the beams. While capable of providing a platform over adjacent beams or joists, unitary platforms have a few drawbacks. For example, the units can be bulky and hard to both (a) transport and (b) maneuver into position, particularly when space is tight a la an attic. So, a need still exists for compact, easily-transportable and easily-maneuverable platforms or other supports that may be positioned over the space between two beams/joists so that safety threats and navigational challenges can be reduced or eliminated.

SUMMARY OF THE PRIOR ART

The prior art known to the applicant is as follows:

U.S. Pat. No. 8,161,690 by Borne et al. (circa 2012) discloses an "interlocking portable rollout attic flooring with overlapping planks."

JoistMate™ by William Frick Corp. (circa 2010) discloses a "non-metal work surface, namely, temporary movable floor support platforms for use over beams and floor joists in construction and repair of buildings."

USD731080 by William Frock & Co. (circa 2013) discloses the ornamental appearance of a "movable platform."

Residential hinge by Guden Custom Hinges (hinges.com) disclose the basic structure of a hinge, including Monroe hinges.

U.S. Pat. No. 8,733,059 by Hamra (circa 2014) discloses a "plank assembly for use in an attic."

U.S. Pat. No. 9,556,611 by Boing Co. (circa 2017) discloses "methods and apparatus for temporary floor assembly."

U.S. Pat. No. 4,771,586 by Schmidt (circa 1988) discloses "grating bar for floor mats."

U.S. Pat. No. 3,894,370 by Parazader (circa 1975) discloses "reinforced structures incorporating strip deck material."

U.S. Pat. No. 3,730,140 by Bowser et al (circa 1973) discloses a "slat floor assembly."

U.S. Pat. No. 2,551,976 by Smith (circa 1945) discloses a "osteopathic bed slat."

U.S. Pat. No. 945,575 by McPherson (circa 1908) discloses a "mat or tread."

U.S. Pat. No. 488,371 by Smith (circa 1892) discloses "slatted structure for floor, stairs, &c."

U.S. Pat. No. 48,907 by Colby (circa 1865) disclose "flooring or dust rack for carpets."

U.S. Pat. No. 4,568,587 by Balzer (circa 1986) discloses a "rollup floor mat with rigid rails."

U.S. Pat. No. 3,913,291 by Dulien et al. (circa 1975) discloses "flexible metal duckboard flooring."

U.S. Pat. No. 6,968,652 by Eadie (circa 2005) discloses "flooring device for positioning on joists."

U.S. Pat. No. 4,681,482 by Areiszewski et al. (circa 1987) discloses "rollable temporary roadway and apparatus for rolling up an installed temporary roadway."

US20160129299A1 by Newman (circa 2016) discloses "hinged interlocking tiles."

U.S. Pat. No. 5,966,777 by Jantschek (circa 1999) discloses a "hinge."

"Portable rolling/folding aluminum ramp stage and ladder" by Longman Intl Group, Co. LTD. www.Longmanlight.com.

SUMMARY OF THE INVENTION

In view of the foregoing, an object of this specification is to disclose a rollable platform that may be unfurled in any orientation over exposed floor or ceiling joists. In particular, the platform may be unfurled perpendicular to, oblique to, or parallel to exposed floor or ceiling joists. In a preferred embodiment, the platform is constructed of a specific arrangement of support surface panels and underside joint panels to give the platform both (a) rigidity in a direction that is normal to the support surface via gridlock between the support surface panels and (b) foldability and/or rollability in a direction that is normal to the underside joint panels due to hinged interconnection. Preferably, this duality of rigidity and foldability or rollability enables rolling-up of the platform while at the same time enabling the platform to be unfurled over exposed joists or other spaced supports. In a preferred embodiment, support surface panels and joint panels are held together by a dowel or rod around which the panels pivot in one pivotal direction around the rod but gridlock in the other pivotal direction around the rod.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 5 is a front view of the unfurlable gridlocked platform 1000;

FIG. 6 is a rear view of the unfurlable gridlocked platform 1000

FIG. 7 is a left-side view of the unfurlable gridlocked platform 1000;

FIG. 8 is a right-side view of the unfurlable gridlocked platform 1000;

Figure 1:
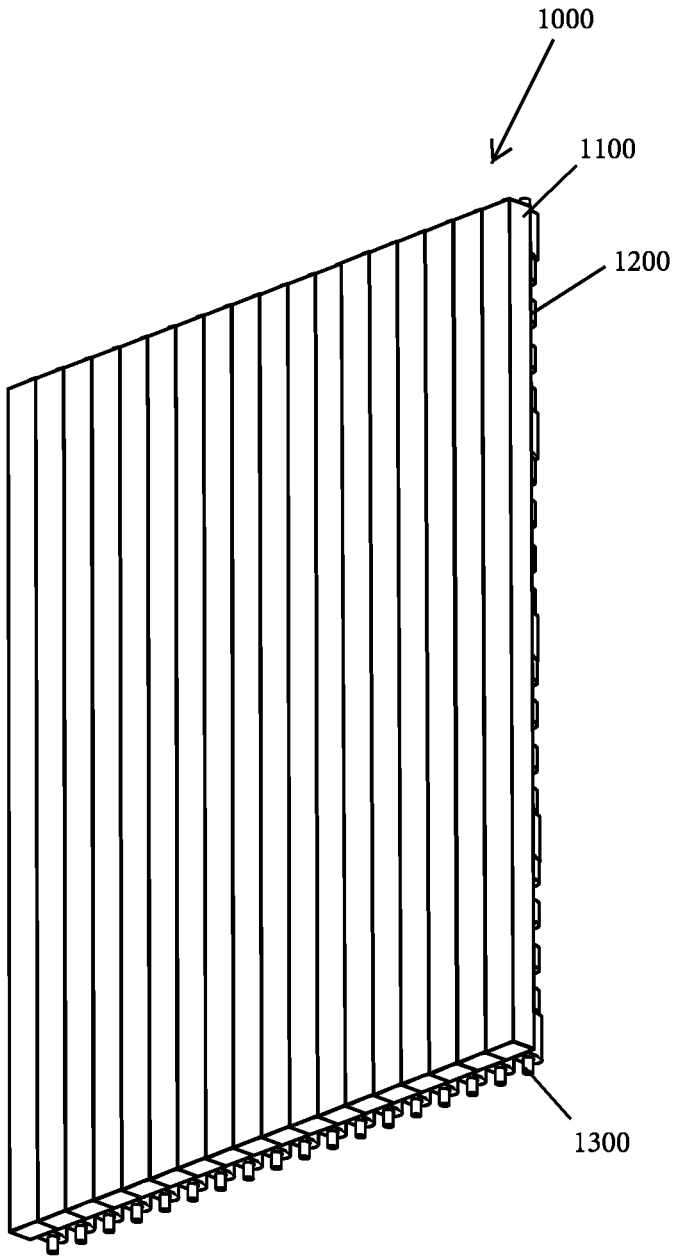
FIG. 1 is a top perspective view of the unfurlable gridlocked platform 1000.

In the figures the following components are represented by the associated reference numeral:

Platform—1000;
Support surface panel—1100;
Surface barrel—1110;
Surface barrel shaft—1111;
Surface barrel space 1115;
Underside joint panel—1200
Barrel side—1201;
Knuckle side—1202;
Joint barrel—1210;
Joint barrel shaft—1211;
Joint barrel gap—1212;
Joint barrel space—1215;
Joint knuckle; 1220;
Joint knuckle shaft—1221;
Joint knuckle space—1225;
Hinge pin—1300;
Normal force—2000; and,
Exposed joists or beams—3000.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a rollable platform that may be unfurled in any orientation over exposed floor or ceiling joists. In particular, the platform may be unfurled perpendicular to, oblique to, or parallel to exposed floor or ceiling joists. In a preferred embodiment, the platform is constructed of a specific arrangement of support surface panels and underside joint panels to give the platform both (a) rigidity in a direction that is normal to the support surface via gridlock between the support surface panels and (b) foldability and/or rollability in a direction that is normal to the underside joint panels due to hinged interconnection. Preferably, this duality of rigidity and foldability or rollability enables rolling-up of the platform while at the same time enabling the platform to be unfurled over exposed joists or other spaced supports. In a preferred embodiment, support surface panels and joint panels are held together by a dowel or rod around which the panels pivot in one pivotal direction around the rod but gridlock in the other pivotal direction around the rod. The more specific aspects of the disclosed platform are described in connection with the figures.

Figure 2:
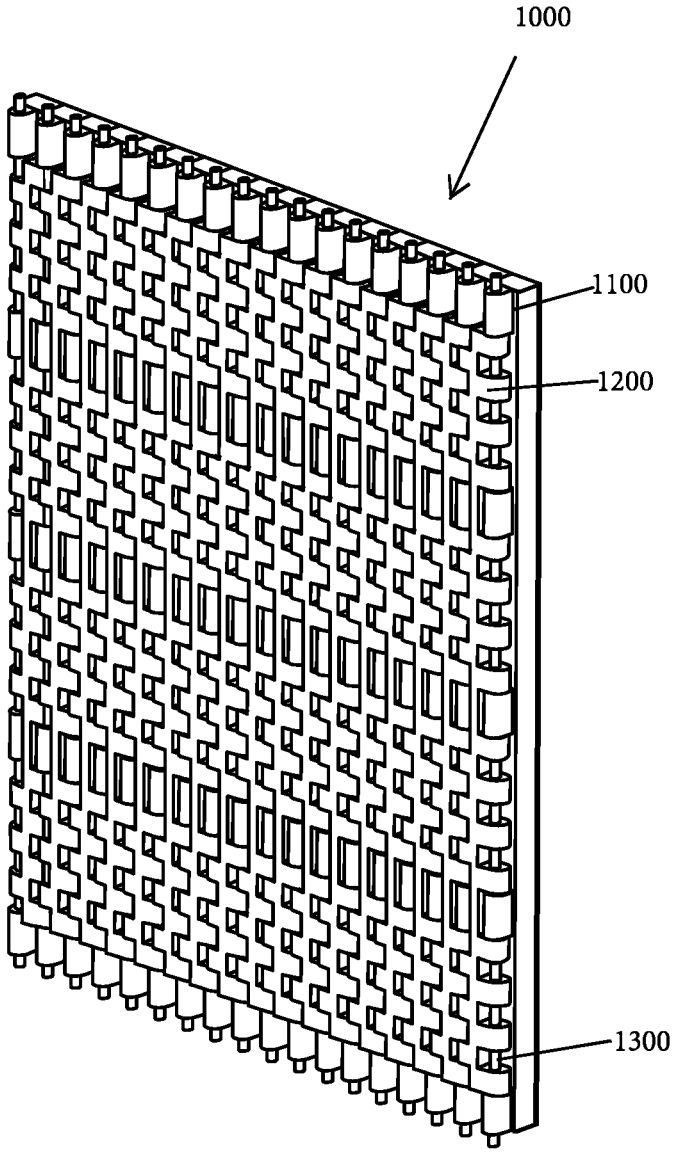
FIG. 2 is bottom perspective view of an unfurlable gridlocked platform 1000.
Figure 3:
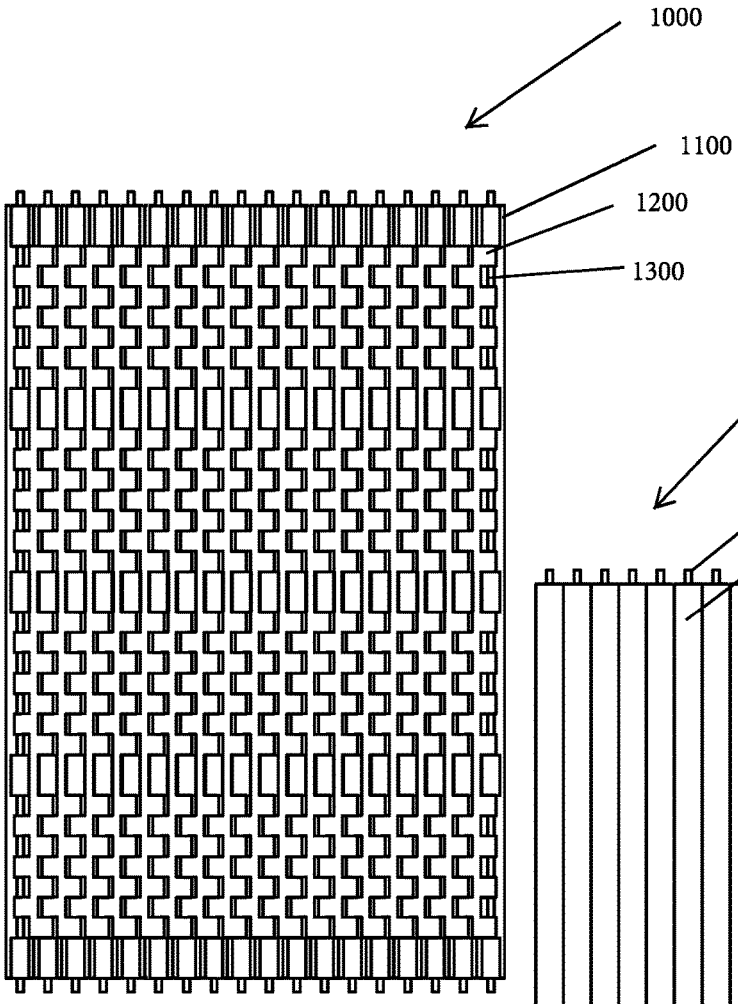
FIG. 3 is bottom view of the unfurlable gridlocked platform 1000.
Figure 4:
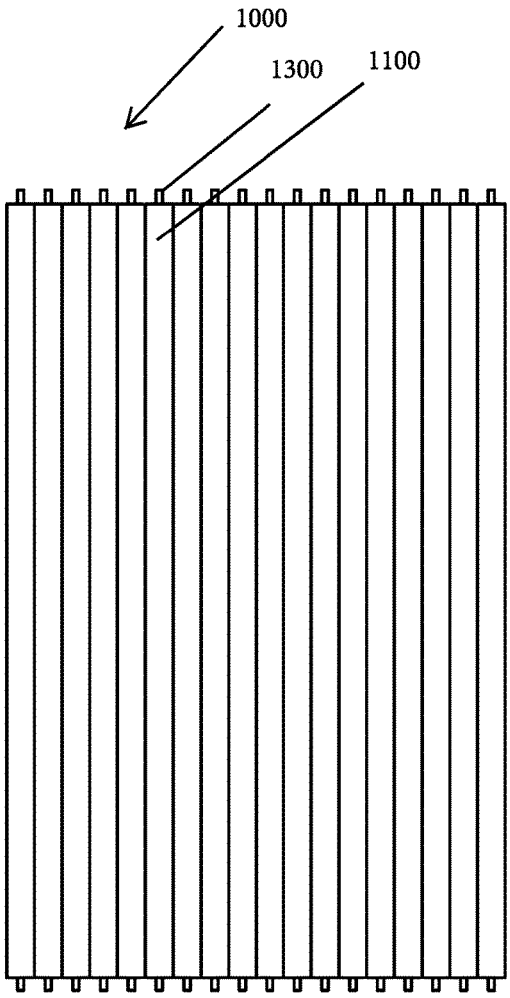
FIG. 4 is a top view of the unfurlable gridlocked platform 1000.

FIG. 1 is a top perspective view of the unfurlable gridlocked platform 1000. FIG. 2 is bottom perspective view of an unfurlable gridlocked platform 1000. FIGS. 3 through 8 are respectively a bottom view, a top view, a front view, a rear view, left-side view, and, a right-side view of the unfurlable gridlocked platform 1000. As shown, the platform is preferably square or rectangular in form. In a preferred embodiment, the dimensions of the platform are 54.00±0.050 inches in length, 18.50±0.50 inches in width, 0.75±0.050 inches in thickness. The preferred embodiment of the platform 1000 is suitably dimensioned to span between two exposed floor or ceiling joists. The load bearing surface of the platform 1000 is preferably defined by a plurality of support surface panels 1100. The downside surface of the platform 1000 is suitably defined by a plurality of underside joint panels 1200. In one embodiment, the joint and surface panels are pivotally coupled via a hinge pin 1300.

Figure 9:
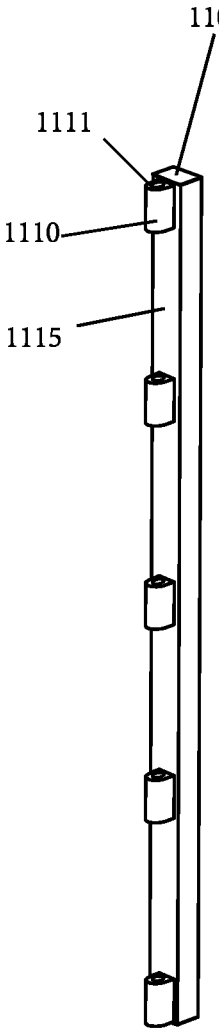
FIG. 9 is a perspective view of a support surface panel 1100.

FIG. 9 is a perspective view of a support surface panel 1100. As shown, the support surface panel 1100 is defined by an elongated slat or plank and comprises a blank side and an underside with a plurality of surface barrels 1110 separated by a surface barrel spaces 1115. In a preferred embodiment the plank of the support surface panel 1110 is 18.50±0.50 inches in length, ⅝±⅛ inches in width, and ⅜±⅛ inches in thickness. Suitably, the surface barrels 1110 define a semicircular arch with a radius of 3/16±⅛ inches, a thickness of ⅜±⅛ inches, a length of ¾±⅛ inches, and a width of ⅜±⅛ inches. Suitably, the surface barrel spaces 1115 are 3.75±0.50 inches between adjacent barrels 1110. In one embodiment, the surface barrels 1110 feature a surface barrel shaft 1111 for, as discussed in greater detail below, accepting hinge pin 1300 (not shown in FIG. 9). As such, the shaft 1111 should be dimensioned to pivotally accept the hinge pin 1300 (not shown in FIG. 9). In a preferred embodiment, the support surface panel is constructed of plastic and is three-dimensionally printed. However, the panel could be constructed of any material (like woods, plastics, or metals) and can be constructed by any technique or processes (like injection molding, carving, cutting casting, and the like) known to those of skill in the art.

Figure 10:
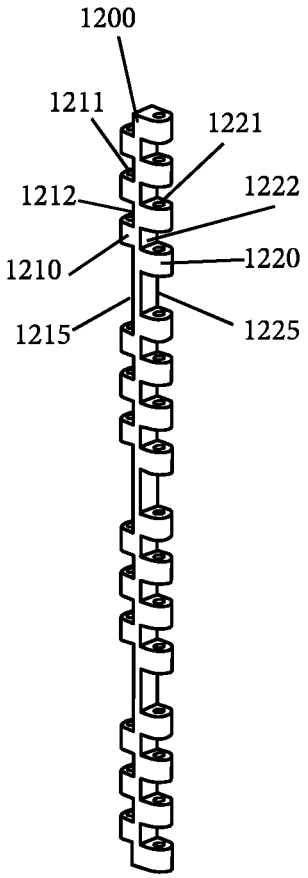
FIG. 10 is a perspective view of an underside joint panel 1200.

FIG. 10 is a perspective view of an underside joint panel 1200. As shown, the underside joint panel 1200 is defined by an elongated slat or plank and comprises a barrel side 1201 and a knuckle side 1202. The barrel side 1201 is defined by a plurality of joint barrels 1210 separated by either joint barrel gaps 1212 or joint barrel spaces 1215. The knuckle side 1202 is defined by a plurality of joint knuckles 1220 separated by either joint knuckle gaps 1222 or joint knuckle spaces 1225. In a preferred embodiment the plank of the underside joint panel 1210 is 17.50±0.50 inches in length, ¼±⅛ inches in width, and ⅜±⅛ inches in thickness. Suitably, the joint barrels 1210 and knuckles define a semicircular arch with a radius of 3/16±⅛ inches, a thickness of ⅜±⅛ inches, a length of ½±⅛ inches, and a width of ⅜±⅛ inches. Suitably, the joint barrel gaps 1212 are ½±⅛ inches between adjacent barrels 1210 and joint barrel spaces 1215 are 2.0±⅛ inches between adjacent barrels 1210. Suitably, the joint knuckle gaps 1222 are ½±⅛ inches between adjacent knuckles 1220 and joint knuckle spaces 1225 are 1.0±⅛ inches between adjacent knuckles 1220. In one embodiment, the joint barrels 1210 and joint knuckles 1220 feature respectively a joint barrel shaft 1211 and a joint knuckle shaft 1221 for, as discussed in greater detail below, accepting hinge pin 1300 (not shown in FIG. 10). As such, the shafts 1211, 1221 should be dimensioned to pivotally accept the hinge pin 1300 (not shown in FIG. 10). In a preferred embodiment, the support surface panel 1000 is constructed of plastic and is three-dimensionally printed. However, the panel could be constructed of any material (like woods, plastics, or metals) and can be constructed by any technique or process (like injection molding, carving, cutting casting, and the like) known to those of skill in the art.

The pattern of knuckles 1220 and barrels 1210 of the joint panel is noteworthy. In a preferred embodiment, the panels 1200 are configured on one side with sets of three barrels 1210 wherein each barrel 1210 in a set of three barrels 1210 is separated by a barrel gap 1212 and each set of three barrels 1210 is separated by a joint barrel space 1215. In the depicted embodiment, the panels are configured on one side with sets of five knuckles 1220, wherein each knuckle 1220 in each set of five knuckles 1220 are separated by a knuckle gap 1222 and each set of five knuckles 1220 are separated by a knuckle space 1225. Other patterns may be used without departing from the spirit and intent of this specification.

Figure 11:
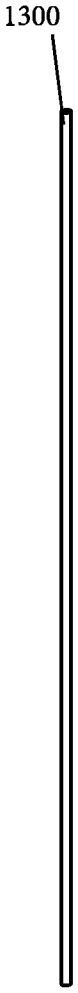
FIG. 11 is a perspective view of a hinge pin 1300.

FIG. 11 is a perspective view of a hinge pin 1300. As shown, the hinge pin 1300 is an elongated cylinder. In a preferred embodiment, the hinge pin 1300 is rigid and configured to be strung through the shafts 1111, 1211, 1221 of the support surface panel 1100 and the underside joint panel 1200. In a preferred embodiment, the hinge pin 1300 is constructed of plastic and is three-dimensionally printed. However, the pin 1300 could be constructed of any material (like woods, plastics, or metals) and can be constructed by any technique or process (like injection molding, carving, cutting casting, and the like) known to those of skill in the art. In a preferred embodiment, the hinge pin 1300 is 3/16 inches in diameter and 19.00 inches long.

Figure 12:
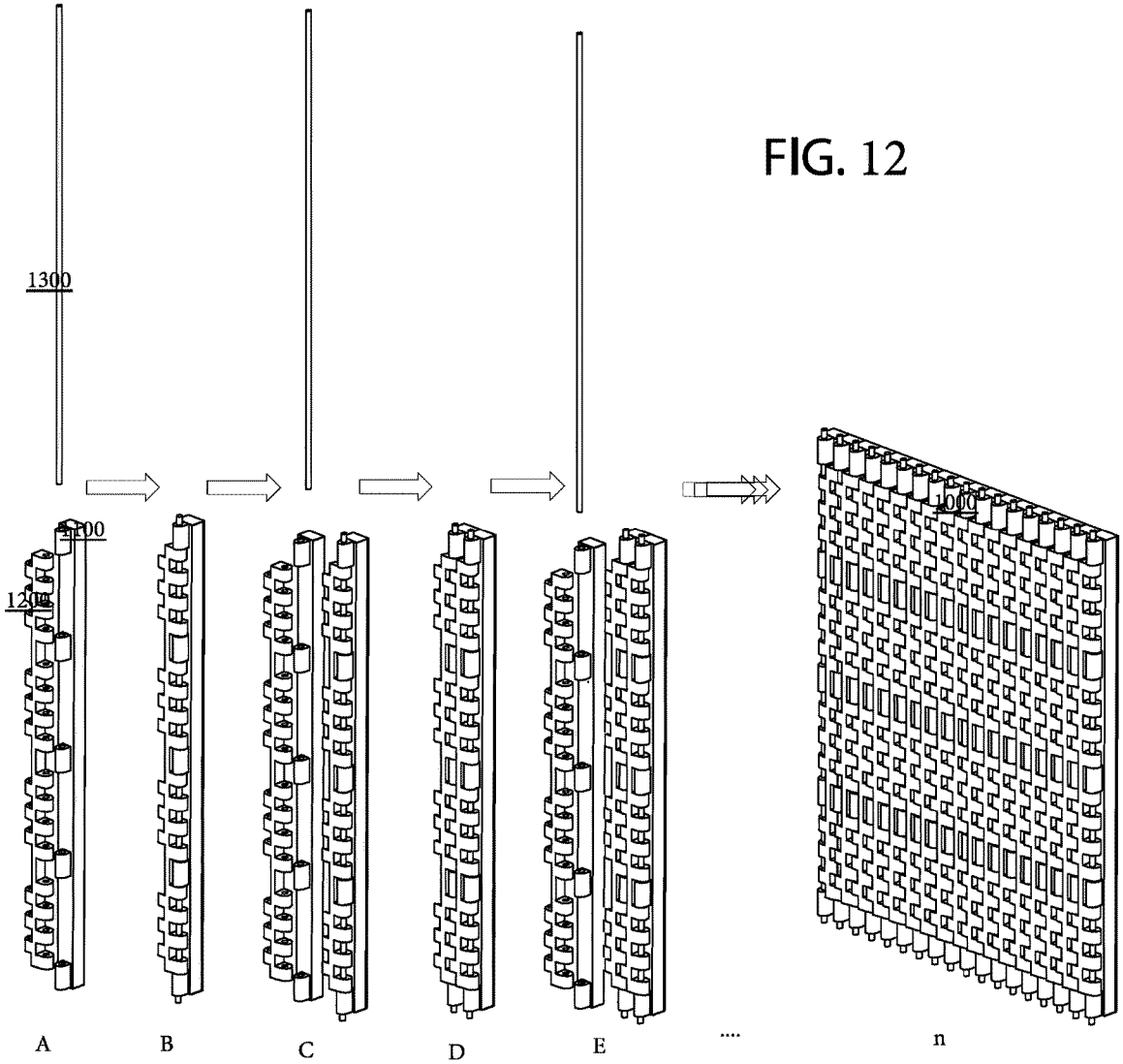
FIG. 12 is a flow chart for constructing the unfurlable gridlocked platform 1000 via assembling a plurality of support surface panels 1100, underside joint panels 1200, and hinge pins 1300.

FIG. 12 is a flow chart for constructing the unfurlable gridlocked platform 1000 via assembling a plurality of support surface panels 1100, underside joint panels 1200, and hinge pins 1300. The flow chart shows a left to right progression of assembling the platform 1000 using a support surface panel 1100, an underside joint panel 1200, and a hinge pin 1300. The columns are ordered alphabetically between column A, the first column, and column n, where "n" signifies that the flow for constructing a panel 1000 can continue for any number of steps after those shown in the figure.

Starting on the left in column A, a support surface panel 1100 may be positioned so that the barrels 1110 are projected. Next, an underside joint panel 1200 may be positioned over the support surface panel 1000 so that the barrels 1000 are provided into corresponding joint knuckle spaces 1225 in a way that aligns the joint knuckle shafts 1221 with the barrel shafts 1111. Third, a hinge pin 1300 may be provided through the shafts 1221, 1111 to create an assembly of a support surface panel 1100, an underside joint panel 1200, and a hinge pin 1300 shown in column B.

Moving to column C, another set of components (including surface panel 1100, underside joint panel 1200, and hinge pin 1300) is setup next to the assembly shown in column B. Specifically, the joint surface panel 1200 from the assembly of column B is first positioned so that its joint barrels 1210 are projected. Next, the new joint panel 1200 is set alongside the joint surface panel of the assembly of column B so that the joint barrels 1210 of the assembly of column B are interlocked with the joint knuckles 1220 of the new joint panel 1200 (e.g., so that each joint barrels 1210 of the assembly of column B are provided to the joint knuckle gaps 1222 of the new joint panel 1200 and the joint knuckles of the new joint panel 1200 are provided to the joint barrel gaps 1212 of the assembly of column B). Third, the new support surface panel 1100 is positioned so that its barrels 1110 are positioned both (a) in the joint knuckle space 1225 of the new joint panel 1200 and (b) in the join barrel space 1215 of the assembly of column B. Finally, the new hinge pin 1300 may be provided through the shafts 1221, 1111 of the new joint panel 1200 and surface panel 1100 and the shaft 1211 of the assembly of column B to create an assembly of a support surface panels 1100, an underside joint panels 1200, and a hinge pins 1300 shown in column D.

Moving to column E, yet another set of components (including surface panel 1100, underside joint panel 1200, and hinge pin 1300) may be setup next to the assembly shown in column D. Specifically, the joint surface panel 1200 from the assembly of column D is first positioned so that its joint barrels 1210 are projected. Next, the new joint panel 1200 is set alongside the joint surface panel of the assembly of column B so that the joint barrels 1210 of the assembly of column D are interlocked with the joint knuckles 1220 of the new joint panel 1200 (e.g., so that each joint barrels 1210 of the assembly of column D are provided to the joint knuckle gaps 1222 of the new joint panel 1200 and the joint knuckles of the new joint panel 1200 are provided to the joint barrel gaps 1212 of the assembly of column D). Third, the new support surface panel 1100 is positioned so that its barrels 1110 are positioned both (a) in the joint knuckle space 1225 of the new joint panel 1200 and (b) in the join barrel space 1215 of the assembly of column D. Finally, the new hinge pin 1300 may be provided through the shafts 1221, 1111 of the new joint panel 1200 and surface panel 1100 and the shaft 1211 of the assembly of column D to create yet an assembly of a support surface panels 1100, an underside joint panels 1200, and a hinge pins 1300 (not shown). The process may repeated "n" number of times until a platform 10000 shown in column n is constructed. It should be noted that, even though the platform 1000 shown in column n is of constructed a definite number of panels 1200, 1100, a platform may be constructed of any number of panels 1200, 1100 without departing from the spirit and intent of this specification.

Figure 13:
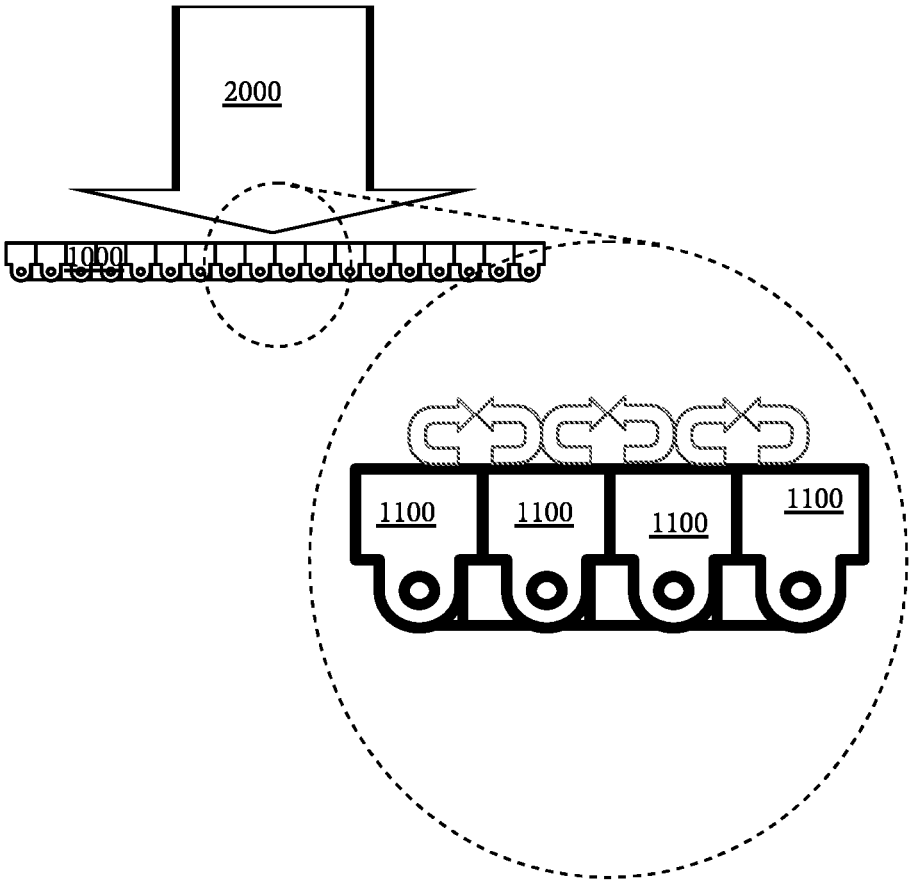
FIG. 13 is an environmental view of the unfurlable gridlocked platform 1000 that illustrates the gridlock of the support surface panels 1100.

FIG. 13 is an environmental view of the unfurlable gridlocked platform 1000 that illustrates the gridlock of the support surface panels 1100. As shown, the platform 1000 is unfurled so that the sides of each of the interstitial surface panels 11000 of the platform abut the sides of any adjacent surface panels 11000. As shown in the figure, when a normal force 2000 is applied to the support surface of the platform 1000 the surface panels' 1100 gridlock as illustrated by the arrows shown in the zoom-in view of FIG. 13. Although the force is depicted as a normal force, it should be understood that any force applied to the surface that has a normal component will be substantially supported by gridlocked panels 1100 up to the point of material failure of the panels 1100, 1200. Accordingly, the panels 1100, 1200 should be constructed of materials (plastics, metals, woods, etc) that can withstand forces inherent to supporting human body weights plus technician tools. In a preferred embodiment, the platform should be capable of supporting 100 lbs to 500 lbs or more without material failure.

Figure 14:
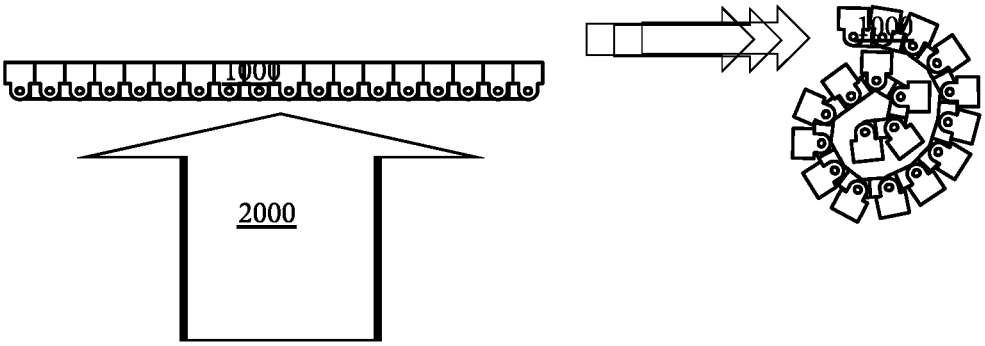
FIG. 14 is an environmental view of the unfurlable gridlocked platform 1000 that illustrates a rolled-up configuration.

FIG. 14 is another environmental view of the unfurlable gridlocked platform 1000 that illustrates a rolled-up configuration. FIG. 14 illustrates a flow of a platform 1000 from an unfurled position to a rolled-up configuration. As shown in the figure, when a normal force 2000 is applied to the underside joint surface of the platform 1000 the joint panels 1200 rotate or pivot around the respective hinge pins 1300. More specifically, adjacent joint panels 1200 rotate around a coupling hinge pin 1300 so that the platform may be rolled. Although the force is depicted as a normal force, it should be understood that any force applied to the surface that has a normal component will substantially result in a rolled platform 1200 as can be readily ascertained by one of skill in the art after reading this specification.

FIG. 14 is another environmental view of the unfurlable gridlocked platform 1000 that illustrates a rolled-up configuration. FIG. 14 illustrates a flow of a platform 1000 from an unfurled position to a rolled-up configuration. As shown in the figure, when a normal force 2000 is applied to the underside joint surface of the platform 1000 the joint panels 1200 rotate or pivot around the respective hinge pins 1300. More specifically, adjacent joint panels 1200 rotate around a coupling hinge pin 1300 so that the platform may be rolled. Although the force is depicted as a normal force, it should be understood that any force applied to the surface that has a normal component will substantially result in a rolled platform 1200 as can be readily ascertained by one of skill in the art after reading this specification.

FIG. 14, in reverse, illustrates a flow of a platform 1000 from a rolled-up configuration position to an unfurled position. Typically, the platform 1000 may be unrolled and setup by placing the rolled-up platform 1000, surface panel 11000 side down, and unrolling the platform 1000. As can be apparent, the underside joint panel 1200 of the platform 1000 will be facing upward after unfurling and, as a result, the platform will need to be flipped over (support surface panel 11000 side up) before the platform 1000 is set in place. In an alternative embodiment, not shown, the panels may feature a ripcord that can be strung through the support surface panels 1100 so that the ripcord may be pulled to unfurl the platform 1000.

Figure 15:
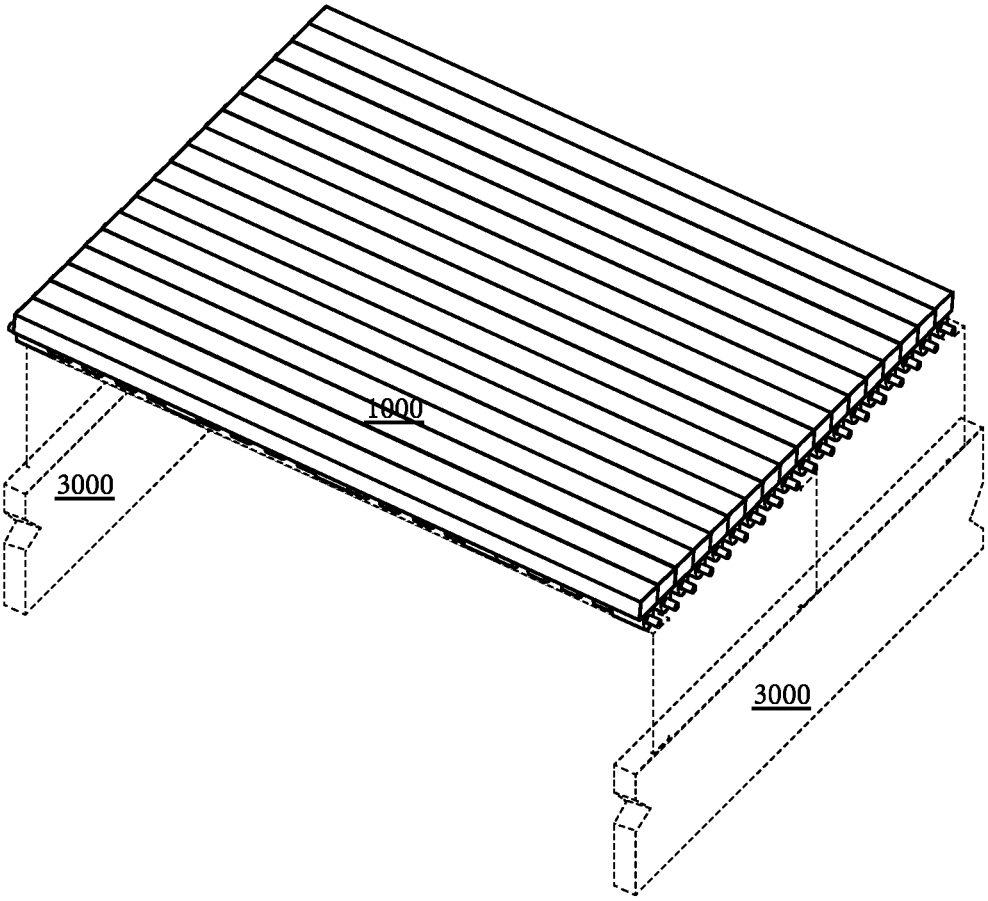
FIG. 15 is an environmental view of the unfurlable gridlocked platform 1000 that is unfurled in a parallel orientation relative to exposed joists 3000.
Figure 16:
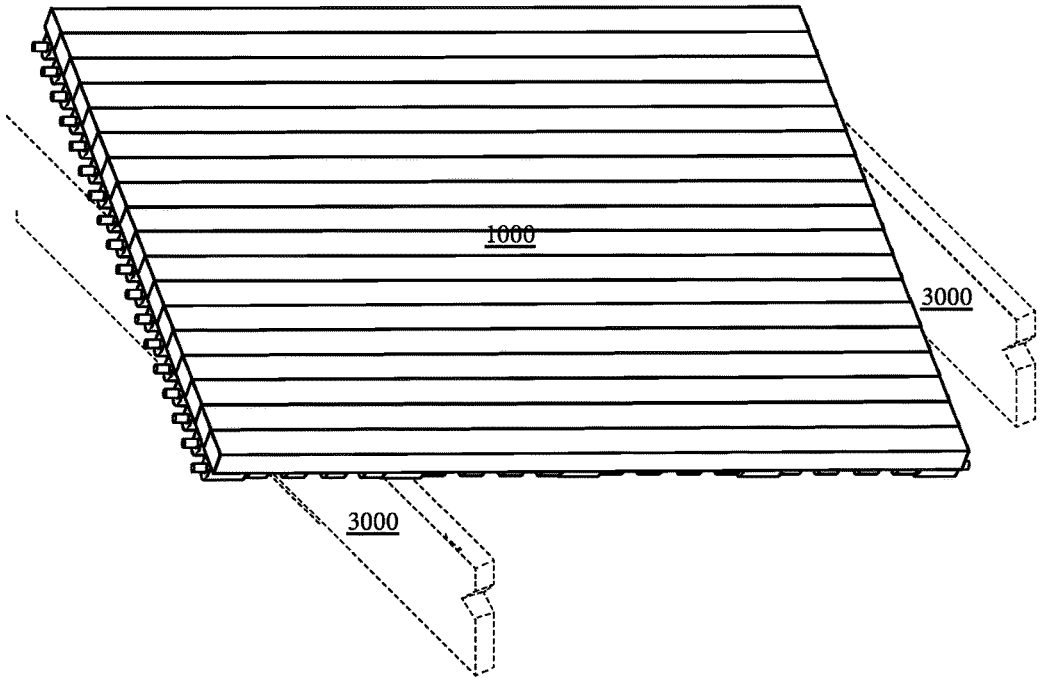
FIG. 16 is an environmental view of the unfurlable gridlocked platform 1000 that is unfurled in a oblique orientation relative to exposed joists 3000.
Figure 17:
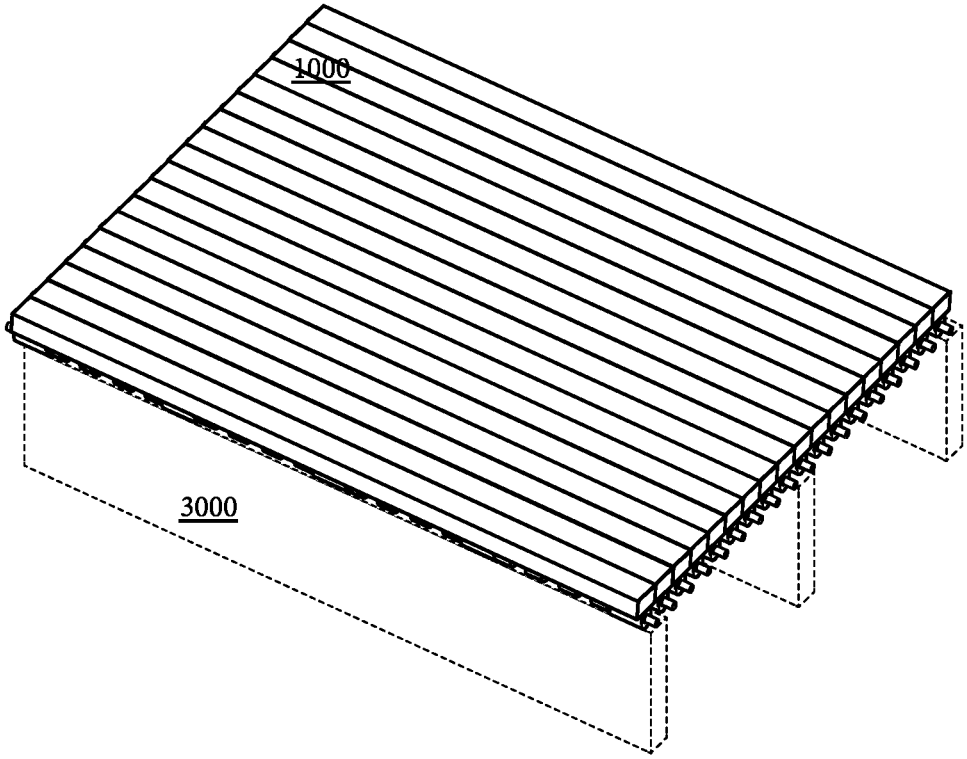
FIG. 17 is an environmental view of the unfurlable gridlocked platform 1000 that is unfurled in a perpendicular orientation relative to exposed joists 3000.
Figure 18:
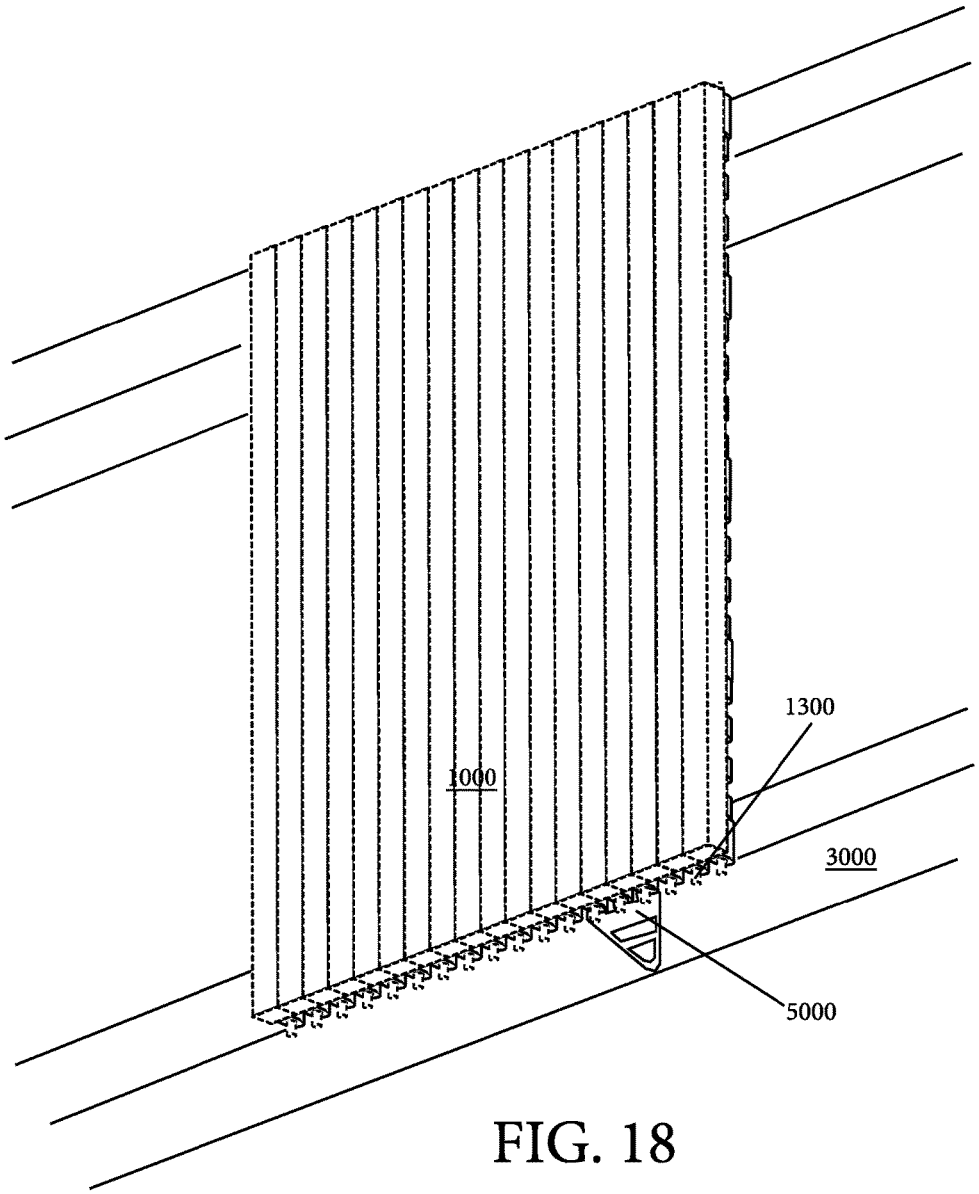
FIG. 18 is an environmental view of a position locking device 5000 for the unfurlable gridlocked platform.

FIG. 15 is an environmental view of the unfurlable gridlocked platform 1000 that is unfurled in a parallel orientation relative to exposed joists 3000. FIG. 17 is an environmental view of the unfurlable gridlocked platform 1000 that is unfurled in a oblique orientation relative to exposed joists 3000. FIG. 18 is an environmental view of the unfurlable gridlocked platform 1000 that is unfurled in a perpendicular orientation relative to exposed joists 3000. The views in these figures are comparable and illustrate the versatility in operation of the platform 1000. More specifically, the platform may be unfurled (as described above and shown in the figures) to span any two support structures, surface panel 1100 side up, and in any orientation provide a platform 10000.

Figure 19:
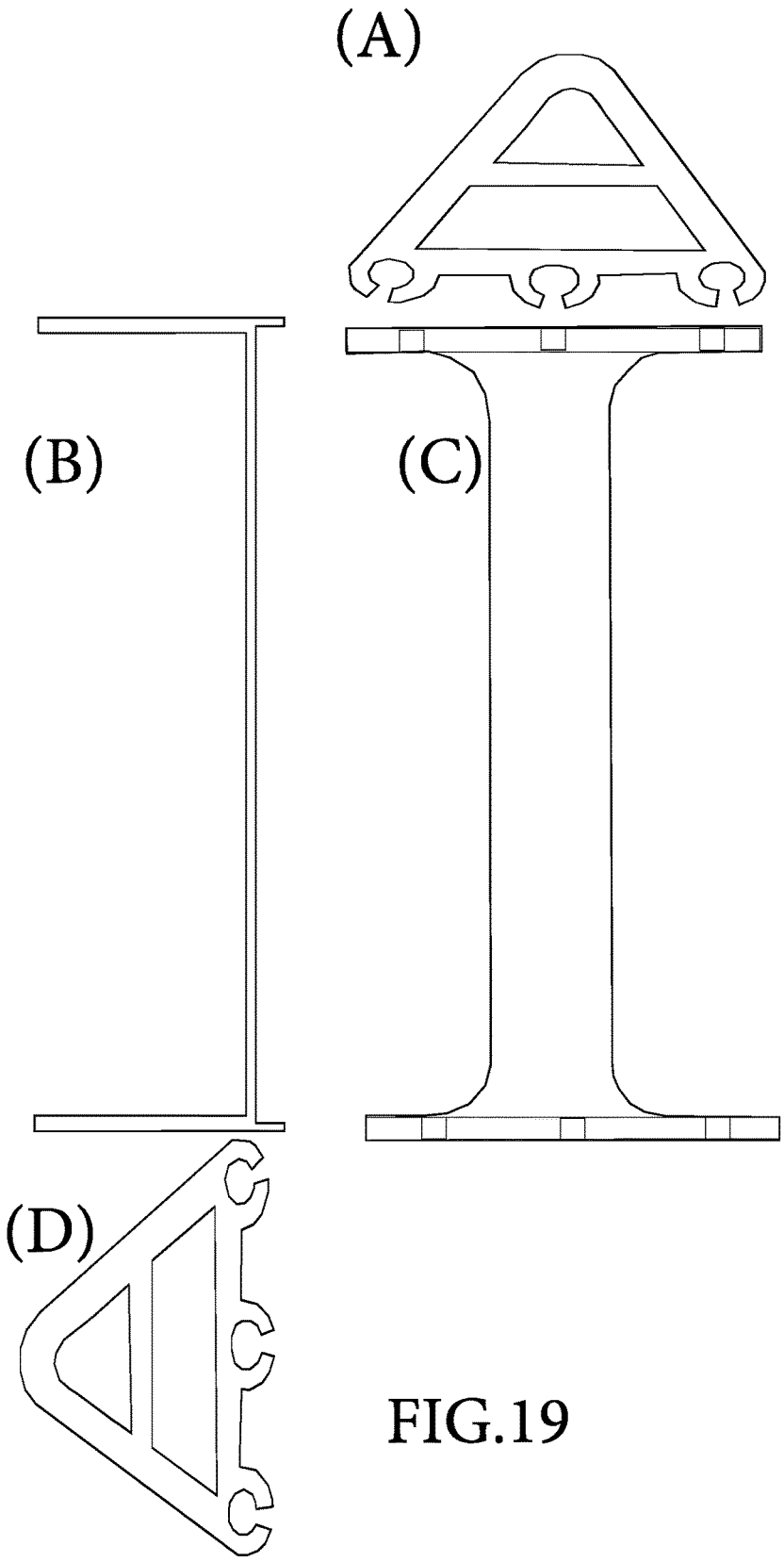
FIG. 19 is a layout of several views of the device 5000 of FIG. 18.

FIG. 18 is an environmental view of a position locking device 5000 for the unfurlable gridlocked platform 1000 that has been unfurled parallel with a joist 3000. FIG. 19 is a layout of several views of the device 5000 of FIG. 18. In a preferred embodiment, the position locking device is configured to interlock with three hinge pins 1300 of the platform 1000 and then interact with the joists 3000 to hold the platform in place. In a preferred embodiment, the device 5000 may include one or more apertures so that a nail or screw may be provided through the device 5000 and joist to further lock the platform 1000 in place.

Figure 20:
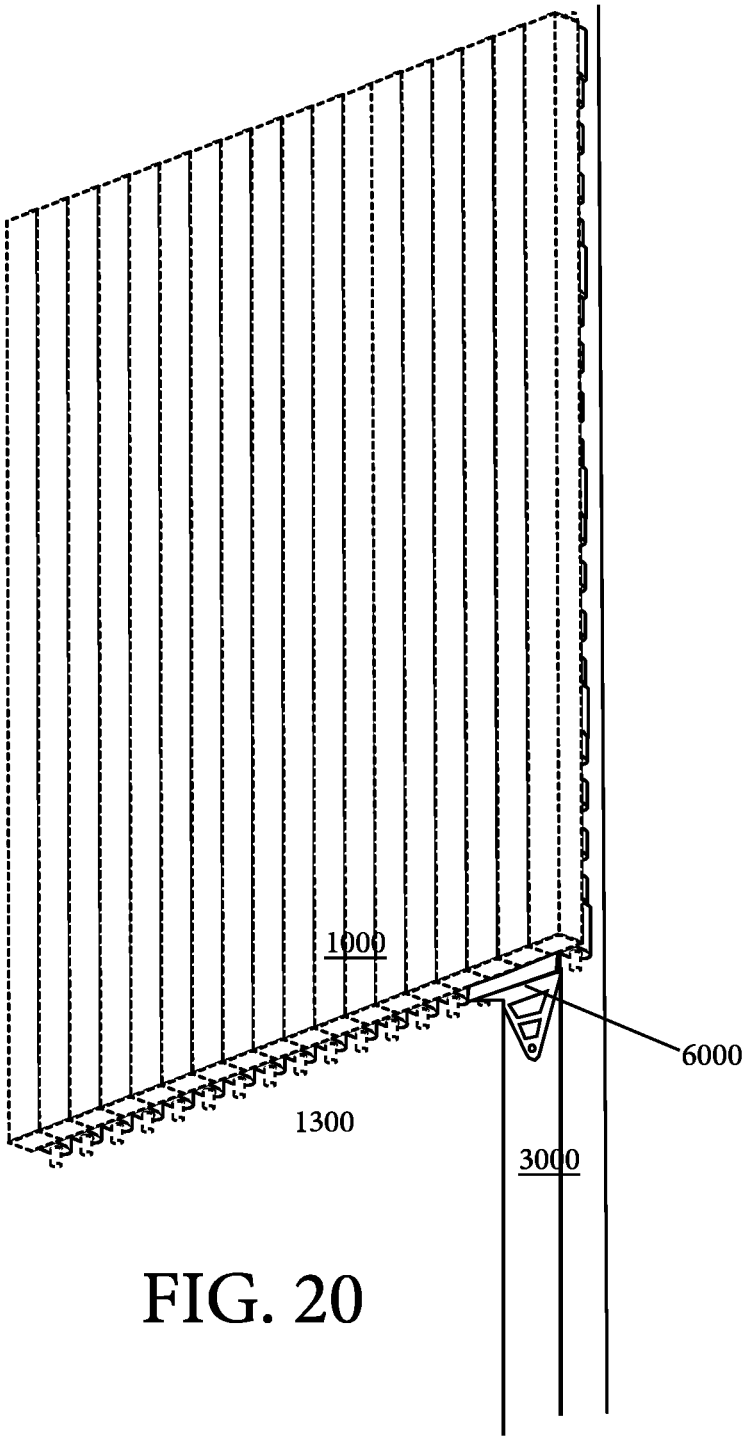
FIG. 20 is an environmental view of a position locking device 6000 for the unfurlable gridlocked platform; and, FIG. 21 is a layout of several views of the device 5000 of FIG. 20.
Figure 21:
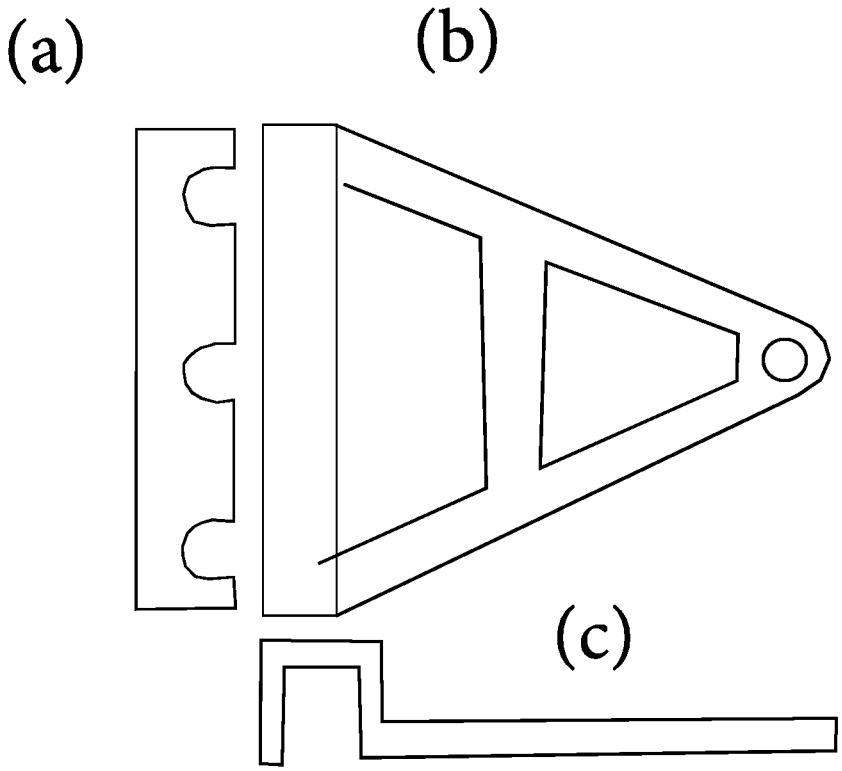

FIG. 20 is an environmental view of a position locking device 6000 for the unfurlable gridlocked platform 1000 that has been unfurled perpendicular with a joist 3000. FIG. 21 is a layout of several views of the device 6000 of FIG. 20. In a preferred embodiment, the position locking device is configured to interlock with three hinge pins 1300 of the platform 1000 and then interact with the joists 3000 to hold the platform in place. In a preferred embodiment, the device 5000 may include one or more apertures so that a nail or screw may be provided through the device 5000 and joist to further lock the platform 1000 in place.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of providing a platform over two joists comprising the step of:

unfurling a gridlocking unfurlable platform across a span located between the two joists in a direction that is one of (i) oblique relative to the two joists, (ii) perpendicular relative to the two joists, or (iii) parallel relative to the two joists; and wherein the gridlocking unfurlable platform comprises:

at least first and second support surface panels, each said support surface panel having a barrel;

at least first and second joint panels, each said joint panel having both a joint barrel and a joint knuckle;

at least first and second hinge pins, where the first hinge pin is strung through the barrel of the first support surface panel and the joint knuckle of the first joint panel and where the second hinge pin is strung through the barrel of the second support surface panel, the joint knuckle of the second joint panel and the joint barrel of the first joint panel; and wherein the at least first and second support surface panels define a structural support surface that gridlocks.

* * * * *